US007828548B2

(12) United States Patent
Riddle

(10) Patent No.: US 7,828,548 B2
(45) Date of Patent: Nov. 9, 2010

(54) REDUCTION KILN

(75) Inventor: Ronald K. Riddle, Bethlehem, PA (US)

(73) Assignee: FLSmidth A/S (DK)

( * ) Notice: Subject to any disclaimer, the term of this patent is extended or adjusted under 35 U.S.C. 154(b) by 257 days.

(21) Appl. No.: 11/657,680

(22) Filed: Jan. 23, 2007

(65) Prior Publication Data

US 2008/0176178 A1 Jul. 24, 2008

(51) Int. Cl.
*C22B 1/00* (2006.01)

(52) U.S. Cl. ..... 432/105; 432/111; 432/117; 266/173; 75/762

(58) Field of Classification Search ..... 432/105, 432/111, 117, 109, 110; 266/163, 173, 213, 266/248; 75/762

See application file for complete search history.

(56) References Cited

U.S. PATENT DOCUMENTS

| | | | | | |
|---|---|---|---|---|---|
| 2,039,062 | A | * | 4/1936 | Debuch | 266/173 |
| 3,171,638 | A | * | 3/1965 | Zimmerley et al. | 432/117 |
| 3,272,616 | A | * | 9/1966 | Brubaker et al. | 75/629 |
| 3,604,692 | A | * | 9/1971 | Smithwick | 432/117 |
| 3,847,538 | A | * | 11/1974 | Rossi | 432/113 |
| 4,427,376 | A | * | 1/1984 | Etnyre et al. | 432/105 |
| 4,993,940 | A | * | 2/1991 | McIlvaine | 432/105 |
| 5,908,291 | A | * | 6/1999 | Dover et al. | 432/107 |

* cited by examiner

*Primary Examiner*—Gregory A Wilson
(74) *Attorney, Agent, or Firm*—Daniel DeJoseph; Aaron Pile

(57) ABSTRACT

Disclosed is a process for reducing metallic oxide or sulfide materials in a rotary kiln and a rotary kiln for reducing such materials. The materials are heated in a reducing atmosphere as they travel along the axial length of the rotary kiln. The materials are discharged from the kiln at a discharge point in the kiln away from its lower material outlet end, wherein the temperature within the kiln at said discharge point is greater than the temperature at the lower material outlet end.

6 Claims, 1 Drawing Sheet

REDUCTION KILN

FIELD OF THE INVENTION

The present invention relates to a method in which oxides or sulfides of metallic materials are treated in a countercurrent reduction rotary kiln such that the metal oxide or sulfide is heated and reduced to the corresponding metal and a novel rotary kiln.

BACKGROUND OF THE INVENTION

Heretofore, it has been known to utilize a rotary kiln to heat treat materials. Such a kiln can be used to reduce materials such as the oxides or sulfides of metallic materials, such as nickel oxide, to a metallic powder by heating the material at a high temperature in a cylindrical rotary kiln in the presence of a reducing agent where the ore is at least partially reduced. Upon leaving the rotary kiln, the ore passes to an electric furnace where it is further reduced to the condition of a molten alloy, the impurities being removed in the form of slag. The prior art rotary kiln utilized in such a process has a first end and a second end, with the first end being for receipt of the materials and the second end for the discharge of the reduced materials. The kiln is inclined generally downwardly and is rotated to advance the materials through the interior of the kiln from the first end to the second end so that, upon rotation, the materials to be reduced will tumble and mix as they advance through the kiln. A reducing medium, such as natural gas substantially free of any oxidizing gases, is primarily introduced into the interior of the kiln through ports near the first end and moves in countercurrent fashion to the direction of movement of the material in the kiln. The gas passes through the material to make initial and intimate contact with material. The contact of such gases with the materials in an oxide or sulfide form at such a high temperature causes a portion of the gas to quickly pyrolytically decompose with an amount thereof being reformed as a strong reducing agent including, for example, carbon monoxide and hydrogen.

The burner in the rotary kiln used to generate the necessary high temperatures will typically project from the discharge end of the kiln axially into the kiln and is fed with liquid, solid or gaseous fuel. A significant issue with conventional reduction kiln technology is the need to also provide combustion air, e.g. oxygen or oxygen-air mixtures at ambient temperature at the kiln product discharge. This practice results in an oxygen rich, cold air stream passing directly over the heated, reduced kiln material prior to discharge. This cold, oxygen rich air cools the product significantly and also oxidizes a portion of the product, thus negatively affecting the amount of reduced material realized via the operation. This, in turn, increases the work necessary in subsequent processing steps, in particular within the downstream electric furnaces.

It is therefore an object of the present invention to provide an improved method of reducing a material in a rotary kiln to its corresponding metal and delivering a higher temperature product to downstream processes such as electric furnaces.

It is a further object of the invention to provide a rotary kiln which, particularly in reducing metallic oxides or sulfides, will facilitate the production of the corresponding metal at a greater yield than realized by the prior art processes described above.

BRIEF DESCRIPTION OF THE DRAWINGS

The above and other objects and features of the present invention will be more apparent from the following description of the preferred embodiments with reference to the accompanying drawings, wherein.

DETAILED DESCRIPTION OF THE INVENTION

It should be understood at the outset that identical reference numbers on the various drawing sheets refer to identical elements of the invention. It should also be understood that the following description is intended to completely describe the invention and to explain the best mode of practicing the invention known to the inventors but is not intended to be limiting in interpretation of the scope of the claims. The drawings are not necessarily to scale, emphasis instead being placed upon illustrating principles of the invention.

Figure 1:
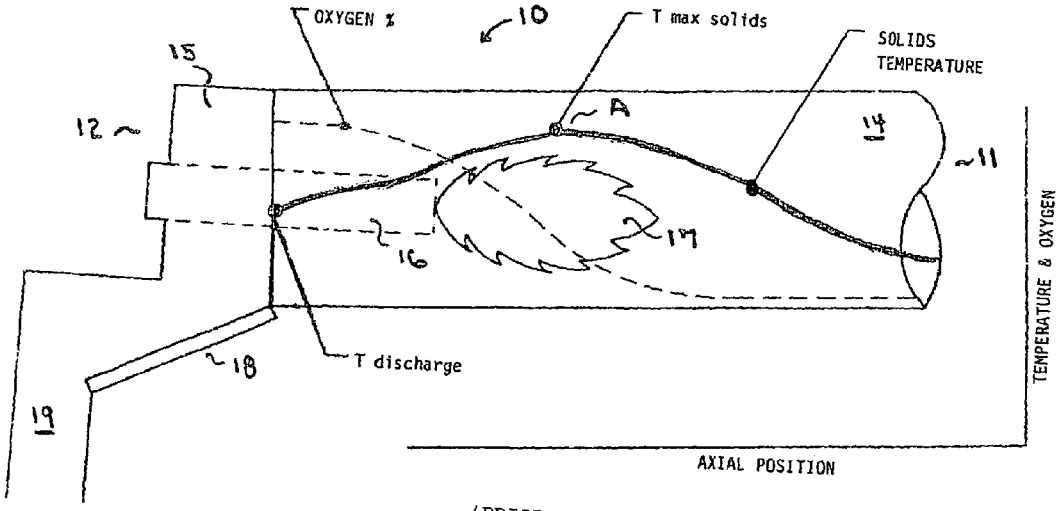
(PRIOR ART) FIGURE 1
FIG. 1 is a cross-sectional view of a prior art reduction kiln on which there is superimposed a profile of the temperature seen by the material treated in the kiln as such material passes down the length of the kiln plus the relative percentage of oxygen present at different locations within the kiln.

With reference to FIG. 1, rotary kiln 10 has a material feed first end 11 and a second end 12 and a cylindrical shell 14. The second end 12 is lower than first end 11 so the force of gravity will assist material in moving through the kiln. In the prior art embodiment depicted in FIG. 1 second end 12 corresponds to the point of material discharge. Material is introduced through conventional charging means (not shown) and will travel from the feed end toward the second end. Second end of the kiln in this prior art embodiment is provided with a hood 15 through which a burner 16 projects into the interior of the kiln, the burner 16 serving to direct a flame 17 axially into the interior of the kiln. The material passes through the kiln while the kiln is rotated whereupon it undergoes at least partial reduction and subsequently exits the kiln at second end 12, whereupon it enters discharge chute 18 and then conduit 19. Simultaneously, oxygen rich combustion gas enters the kiln from the second end 12 and flows countercurrent to the material flow through the kiln.

The location at which there is the maximum reduction of the material in kiln 10 is represented as being at point A, which coincides with the location along the axial length of the kiln at which the material is at its highest temperature and which is typically closer to the second end 12 than feed end 11. For the reduction of nickel oxide, for example, this maximum temperature in a rotary kiln will range from about 1250 to about 1850 degrees Fahrenheit. As the material moves from point A toward the outlet end 12 of the kiln its temperature will decrease as the material encounters ambient combustion air. Because such combustion air has a significantly higher percentage of oxygen content than the primarily reducing air atmosphere encountered by the material from feed end 11 up to point A, a portion of the material will be reoxidized, thus affecting the yield of reduced metal product. As the material continues to move through the kiln to outlet end 12 the temperature at such outlet end 12 will be significantly less (for example, in a typical rotary kiln nickel oxide reduction process, from about 200 to about 300 degrees Fahrenheit less), than the temperature at the maximum reducing point A because of the material encountering the comparatively cool ambient air. Furthermore, the oxygen content at such discharge point will be at the maximum amount within the kiln.

Figure 2:
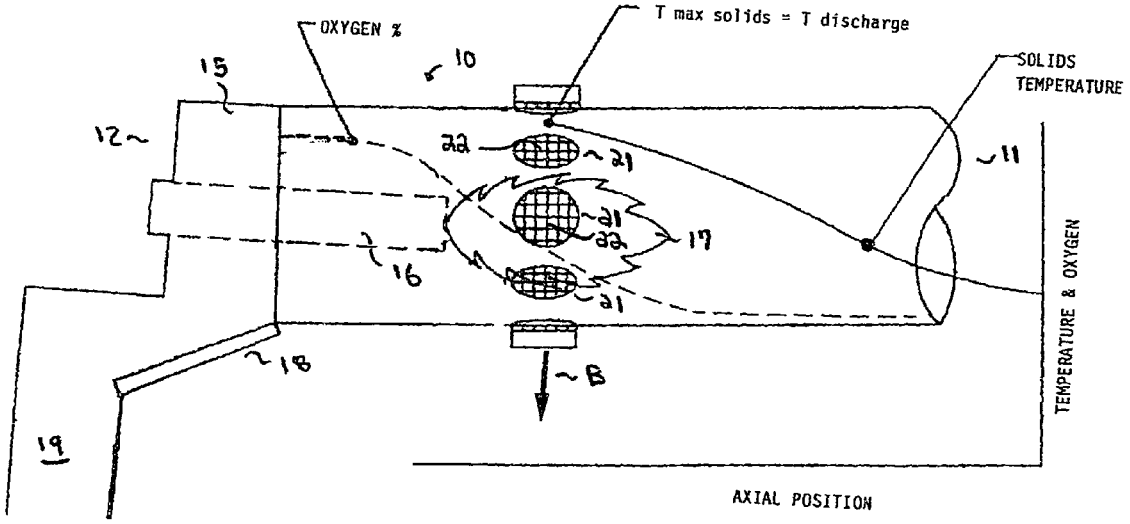
FIG. 2 is a cross-sectional view, also with a superimposed temperature and oxygen profile, of one embodiment of the reduction kiln of the present invention.

FIG. 2 represents the rotary kiln and method of the present invention, with like numerals representing like elements. In FIG. 2, there is a first discharge point of material from the kiln that will most preferably coincide with point A, i.e. that point at which there is maximum reduction of the material within the kiln. Therefore, in the preferred embodiment, the maximum temperature seen by the treated materials within the kiln will also be the discharge temperature of the materials. Although discharge at such point will provide the highest yield of reduced materials, any discharge location in the kiln which yields more of the desired reduced material than would be realized if all the material were discharged at second end 12 can advantageously be utilized as a first discharge point in the present invention. Typically, such higher yield of reduced material will be realized if the material discharges at any point within the axial length of the kiln where the temperature is greater than it is at second end 12. Material that is not, for any reason, discharged from the kiln via the first discharge point will discharge at outlet end 12.

FIG. 2 illustrates a preferred embodiment of the invention in which there is a means to discharge material at that point from the kiln in which the temperature in the exterior of the kiln is at its maximum. In the depicted embodiment there are a plurality of exit holes 21 circumferentially aligned with point A that extend through the shell of the kiln and around its circumference. As kiln 10 rotates material will exit the kiln through the exit holes 21 downward in the direction of arrow B. In the depicted embodiment, the holes are arranged in a grouping that extends around the circumference of the kiln, and are approximately equally spaced from each other and equally spaced axially from outlet end 12. It is appreciated that the determination of the ideal number of exit holes, which can be as few as one, for a given process and material will be left to the skilled artisan. Likewise, the spacing, size and shape of the exit holes for a given application can be determined by one skilled in the art.

In one preferred embodiment, exit holes 21 will be covered by screens 22 of a predetermined mesh size that will serve to separate large size lumps formed in the rotary kiln from the product. It has been known that a common problem with a reduction kiln in, for example, the nickel industry is the formation of large lumps and rings. The material in these lumps is generally calcined, reduced ore. Such comparatively large material presents handling and processing problems downstream from the rotary kiln. Therefore, it is desirable to remove such lumps and rings from the product. Reliable and safe means of dealing with over-sized, i.e. greater than about 6" in diameter, material is a continuing problem for the ferro nickel industry. This problem is overcome by the present invention's preferred use of suitably sized screens which are placed in relationship with exit holes 21 to screen the lumps from the product as the product exits the rotary kiln through exit holes 21. The lumps that are thus prevented from going to product will travel to second end 12 where they will be discharged from the rotary kiln and separately processed. Having the screening operation take place within the kiln is advantageous in that kiln elevation is reduced compared to typical layouts in which the screening function takes place at a location exterior to the kiln.

While the present invention preferably relates to the reduction of nickeliferous materials and maximizing discharge temperatures in a rotary kiln; and most preferably to the reduction of nickel oxide in a rotary kiln to produce nickel metal, the process may also be used, as suggested above, for other metallic materials that require thermal and chemical reduction. Furthermore, those skilled in the materials processing art will recognize that other materials may include compounds of elements which are not metallic that can be reduced in a similar manner. Further, it is recognized that the practitioner of the invention will utilize means known in the art to determine a temperature profile both within the entire interior of the kiln and at the second end 12 when determine where to place exit holes 21. In addition, there can be utilized another exit hole or a grouping of exit holes that comprise a second discharge point in the kiln located intermediate the first discharge point and the kiln outlet.

Accordingly, references herein to the reduction of metallic material or to the increase of metal content are equally applicable to other materials including compounds of elements which are not actually a metal in order to increase the content of at least one of the elements thereof.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A process for reducing metallic oxide or sulfide materials in a rotary kiln comprising a cylindrical shell having a material inlet end and a material outlet end, said process comprising a) inserting the materials into the inlet end of a kiln and moving such materials from the inlet end through the kiln toward the outlet end;

b) introducing a reducing medium into the kiln, said reducing medium coming into contact with the materials as they move through the interior of the kiln;

c) heating the materials in said reducing medium as they travel through the kiln at a temperature sufficient to reduce at least some of the materials to free metal product, said materials moving through said reducing medium in a direction countercurrent to the direction of the flow of the reducing medium through the kiln; and d) discharging materials from the kiln through an opening in the kiln shell at a first discharge point in the kiln which is, with reference to the direction of movement of the materials through the kiln from the inlet end toward the outlet end, located within the kiln at any point from where the temperature within the kiln begins to be greater than the temperature at the outlet end up to and including the point at which the temperature within the kiln is at its maximum, said discharge point being axially removed from the material outlet end.

2. The process of claim 1 wherein the temperature within the kiln at the first discharge point is the maximum temperature within the kiln.

3. The process of claim 1 where the materials to be reduced are nickel oxides.

4. The process of claim 1 further comprising separating material above a predetermined size from the materials discharged from the kiln at the discharge point, with said separated large material exiting the kiln at the material outlet end.

5. The process of claim 1 further comprising also discharging material through the kiln shell at a second discharge point located intermediate the first discharge point and the outlet end.

6. The process of claim 1 wherein the reducing material is a natural gas substantially free of any oxidizing gases.

* * * * *